US012753570B2

(12) United States Patent
Hatake et al.

(10) Patent No.: US 12,753,570 B2
(45) Date of Patent: Oct. 6, 2026

(54) CONTROL DEVICE AND CONTROL METHOD FOR LOADING MACHINE

(71) Applicant: KOMATSU LTD., Tokyo (JP)

(72) Inventors: Kazuhiro Hatake, Tokyo (JP); Yusuke Saigo, Tokyo (JP)

(73) Assignee: Komatsu Ltd., Tokyo (JP)

( * ) Notice: Subject to any disclaimer, the term of this patent is extended or adjusted under 35 U.S.C. 154(b) by 438 days.

(21) Appl. No.: 18/285,338

(22) PCT Filed: Apr. 28, 2022

(86) PCT No.: PCT/JP2022/019296
§ 371 (c)(1),
(2) Date: Oct. 2, 2023

(87) PCT Pub. No.: WO2022/230980
PCT Pub. Date: Nov. 3, 2022

(65) Prior Publication Data

US 2024/0191458 A1 Jun. 13, 2024

(30) Foreign Application Priority Data

Apr. 30, 2021 (JP) ..... 2021-077392

(51) Int. Cl.
*E02F 3/43* (2006.01)
*E02F 9/26* (2006.01)

(52) U.S. Cl.
CPC ..... *E02F 3/437* (2013.01); *E02F 3/439* (2013.01); *E02F 9/265* (2013.01)

(58) Field of Classification Search
CPC ... E02F 3/43; E02F 3/431; E02F 3/432; E02F 3/434; E02F 3/435; E02F 3/436; E02F 3/437; E02F 3/439
See application file for complete search history.

(56) References Cited

U.S. PATENT DOCUMENTS 5,065,326 A * 11/1991 Sahm ..... E02F 3/437 701/50
5,224,033 A * 6/1993 Nakamura ..... E02F 9/221 702/56
5,257,177 A * 10/1993 Bach ..... B66C 13/066 340/685
5,274,557 A * 12/1993 Moriya ..... E02F 9/2296 700/60

(Continued)

FOREIGN PATENT DOCUMENTS

CN 106869203 A 6/2017
JP H11-132071 A 5/1999

(Continued)

*Primary Examiner* — Jamie L Mcgowan
(74) *Attorney, Agent, or Firm* — Fish & Richardson P.C.

(57) ABSTRACT

A start angle determination unit determines a start angle which is an angle of a swing body at the start of loading of a loading machine. The movement control unit outputs an operation signal for driving the swing body until the angle of the swing body reaches the start angle after a bucket has reached a loading point above a loading target, and outputs an operation signal for driving the work equipment until a posture of the bucket with respect to the swing body reaches a preset target posture different from a posture of the bucket at the start of loading.

9 Claims, 10 Drawing Sheets

(56) References Cited

U.S. PATENT DOCUMENTS 5,424,623 A * 6/1995 Allen ..... B25J 9/162 180/324
5,493,798 A * 2/1996 Rocke ..... E02F 3/437 701/50
5,535,532 A * 7/1996 Fujii ..... E02F 3/437 701/50
5,699,247 A * 12/1997 Moriya ..... E02F 3/438 701/1
5,735,066 A * 4/1998 Tochizawa ..... E02F 3/435 701/50
5,794,369 A * 8/1998 Lee ..... E02F 3/436 701/50
6,058,344 A * 5/2000 Rowe ..... E02F 9/2041 701/50
6,275,757 B1 8/2001 Watanabe et al.
6,363,632 B1 * 4/2002 Stentz ..... E02F 9/24 701/50
6,691,010 B1 * 2/2004 Gay ..... G05B 13/0275 701/44
6,778,097 B1 * 8/2004 Kajita ..... E02F 9/2296 342/426
7,979,181 B2 * 7/2011 Clark ..... E02F 9/2029 701/50
8,577,564 B2 * 11/2013 Stanek ..... E02F 3/435 701/50
8,620,533 B2 * 12/2013 Taylor ..... E02F 3/437 701/50
8,768,579 B2 * 7/2014 Taylor ..... E02F 9/264 701/50
8,793,055 B2 * 7/2014 Eklund ..... E02F 9/26 701/1
12,460,373 B2 * 11/2025 Morita ..... E02F 9/123
2010/0226744 A1 * 9/2010 Trifunovic ..... E02F 3/434 414/700
2010/0254793 A1 * 10/2010 Trifunovic ..... E02F 3/432 701/50
2017/0096796 A1 4/2017 Doi et al.
2021/0164192 A1 * 6/2021 Konda ..... E02F 9/262
2021/0246625 A1 * 8/2021 Ol ..... E02F 9/265
2021/0254304 A1 * 8/2021 Konda ..... E02F 3/32

FOREIGN PATENT DOCUMENTS

JP 2020-033825 A 3/2020
JP 2020-033826 A 3/2020
JP 2020-041352 A 3/2020
JP 2021-025258 A 2/2021
WO 98/59118 A1 12/1998

* cited by examiner

CONTROL DEVICE AND CONTROL METHOD FOR LOADING MACHINE

CROSS-REFERENCE TO RELATED APPLICATIONS

This application is a National Stage application under 35 U.S.C. § 371 of International Application No. PCT/JP2022/019296, filed on Apr. 28, 2022, which claims priority to Japanese Patent Application No. 2021-077392, filed on Apr. 30, 2021. The contents of the prior applications are incorporated herein in their entirety.

TECHNICAL FIELD

The present disclosure relates to a control device and a control method for a loading machine.

BACKGROUND ART

Patent Document 1 discloses a technology related to semi-automatic control of a loading machine. The semi-automatic control according to Patent Document 1 is a control performing automatic excavation by a control device receiving an excavation instruction from an operator after completion of loading with respect to a loading target such as a dump truck and controlling swinging of the loading machine and driving of the work equipment.

CITATION LIST

Patent Document

Patent Document 1

Japanese Unexamined Patent Application, First Publication No. 2020-041352

SUMMARY OF INVENTION

Technical Problem

Incidentally, when a bucket is moved to a subsequent excavation position after an excavation operation by an operator, it is conceivable to return the bucket to a position at the start of loading. However, since the position at the start of loading is a position at which the bucket has been when the operator has completed the excavation operation, it may not be appropriate as a position for starting excavation.

An objective of the present disclosure is to provide a control device and a control method for a loading machine in which a bucket can be moved to an appropriate position for starting excavation by automatic control of the loading machine.

Solution to Problem

According to one aspect of the present disclosure, a control device for a loading machine is a control device for a loading machine including a swing body swinging around a swing center, a support part supporting the swing body, and work equipment having a bucket and attached to the swing body, and the control device for a loading machine includes a start angle determination unit determining a start angle which is an angle of the swing body at the start of loading of the loading machine, and a movement control unit generating an operation signal for driving the swing body and the work equipment, in which the movement control unit outputs an operation signal for driving the swing body until the angle of the swing body reaches the start angle after the bucket has reached a loading point above a loading target, and outputs an operation signal for driving the work equipment until a posture of the bucket with respect to the swing body reaches a preset target posture different from the posture of the bucket at the start of loading.

Advantageous Effects of Invention

According to the aspect described above, the control device of the loading machine can move the bucket to an appropriate position for starting excavation due to automatic control of the loading machine.

DESCRIPTION OF EMBODIMENTS

First Embodiment

Hereinafter, embodiments will be described in detail with reference to the drawings.

Configuration of Loading Machine 100

Figure 1:
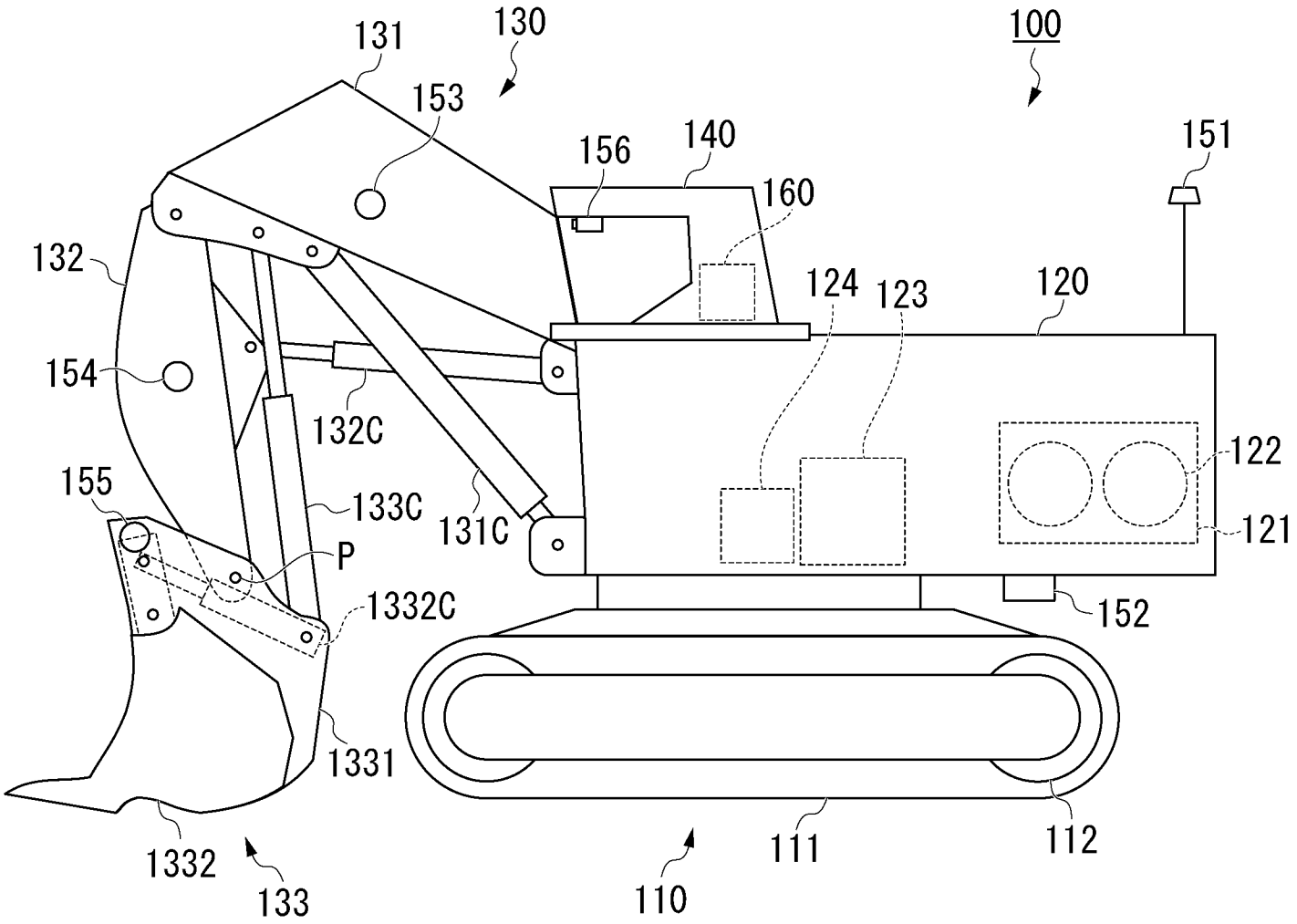
FIG. 1 is a schematic view illustrating a configuration of a loading machine according to a first embodiment.

FIG. 1 is a schematic view illustrating a configuration of a loading machine 100 according to a first embodiment.

The loading machine 100 operates at a construction site, excavates a work object such as earth, and loads it onto a loading target T such as a dump truck. The loading machine 100 according to the first embodiment is a face excavator. Further, a loading machine 100 according to another embodiment may be a backhoe excavator or a rope excavator. The loading machine 100 includes an undercarriage 110, a swing body 120, work equipment 130, and a cab 140.

The undercarriage 110 supports the loading machine 100 to be able to travel. The undercarriage 110 includes two endless tracks 111 provided on the left and right and two traveling motors 112 for driving the endless tracks 111.

The swing body 120 is supported by the undercarriage 110 to be able to swing around a swing center.

The work equipment 130 is driven by a hydraulic pressure. The work equipment 130 is supported by a front portion of the swing body 120 so that it can be driven in a vertical direction. The cab 140 is a space for an operator to be on board and perform an operation of the loading machine 100. The cab 140 is provided in a left front portion of the swing body 120.

Here, a portion of the swing body 120 to which the work equipment 130 is attached is referred to as a front portion. Also, for the swing body 120, with the front portion as a reference, a portion on an opposite side is referred to as a rear portion, a portion on a left side is referred to as a left portion, and a portion on a right side is referred to as a right portion.

Configuration of Swing Body 120

The swing body 120 includes an engine 121, a hydraulic pump 122, a control valve 123, and a swing motor 124.

The engine 121 is a prime mover that drives the hydraulic pump 122. The engine 121 is an example of a power source.

The hydraulic pump 122 is a variable capacity pump driven by the engine 121. The hydraulic pump 122 supplies a hydraulic oil to actuators (a boom cylinder 131C, an arm cylinder 132C, a bucket cylinder 133C, a clam cylinder 1332C, the travel motors 112, and the swing motor 124) via the control valve 123.

The control valve 123 controls a flow rate of the hydraulic oil supplied from the hydraulic pump 122.

The swing motor 124 is driven by the hydraulic oil supplied from the hydraulic pump 122 via the control valve 123 to swing the swing body 120.

Configuration of Work Equipment 130

The work equipment 130 includes a boom 131, an arm 132, a clam bucket 133, the boom cylinder 131C, the arm cylinder 132C, and the bucket cylinder 133C.

A base end portion of the boom 131 is attached to the swing body 120 via a boom pin. Further, in the loading machine 100 illustrated in FIG. 1, the boom 131 is provided at a central portion of a front surface of the swing body 120, but the present invention is not limited thereto, and the boom 131 may be attached with an offset in a left-right direction. In this case, a swing center of the swing body 120 is not positioned on a plane of movement of the work equipment 130.

The arm 132 connects the boom 131 and the clam bucket 133. A base end portion of the arm 132 is attached to a distal end portion of the boom 131 via an arm pin.

The clam bucket 133 includes a backall 1331 attached to a distal end portion of the arm 132 via a pin, a clamshell 1332 having bucket teeth for excavating earth or the like, and the clam cylinder 1332C for opening and closing the backall 1331 and the clamshell 1332. The backall 1331 and the clamshell 1332 are connected via a pin to be openable and closable. When the backall 1331 and the clamshell 1332 are closed, the backall 1331 and clamshell 1332 function as a container for containing excavated earth. On the other hand, when the backall 1331 and the clamshell 1332 open, the accommodated earth can be dumped. A base end portion of the clam cylinder 1332C is attached to the backall 1331. A distal end portion of the clam cylinder 1332C is attached to the clamshell 1332.

The boom cylinder 131C is a hydraulic cylinder for operating the boom 131. A base end portion of the boom cylinder 131C is attached to the swing body 120. A distal end portion of the boom cylinder 131C is attached to the boom 131.

The arm cylinder 132C is a hydraulic cylinder for driving the arm 132. A base end portion of the arm cylinder 132C is attached to the boom 131. A distal end portion of the arm cylinder 132C is attached to the arm 132.

The bucket cylinder 133C is a hydraulic cylinder for driving the clam bucket 133. A base end portion of the bucket cylinder 133C is attached to the boom 131. A distal end portion of the bucket cylinder 133C is attached to a link member connected to the backall 1331.

Configuration of Cab 140

Figure 2:
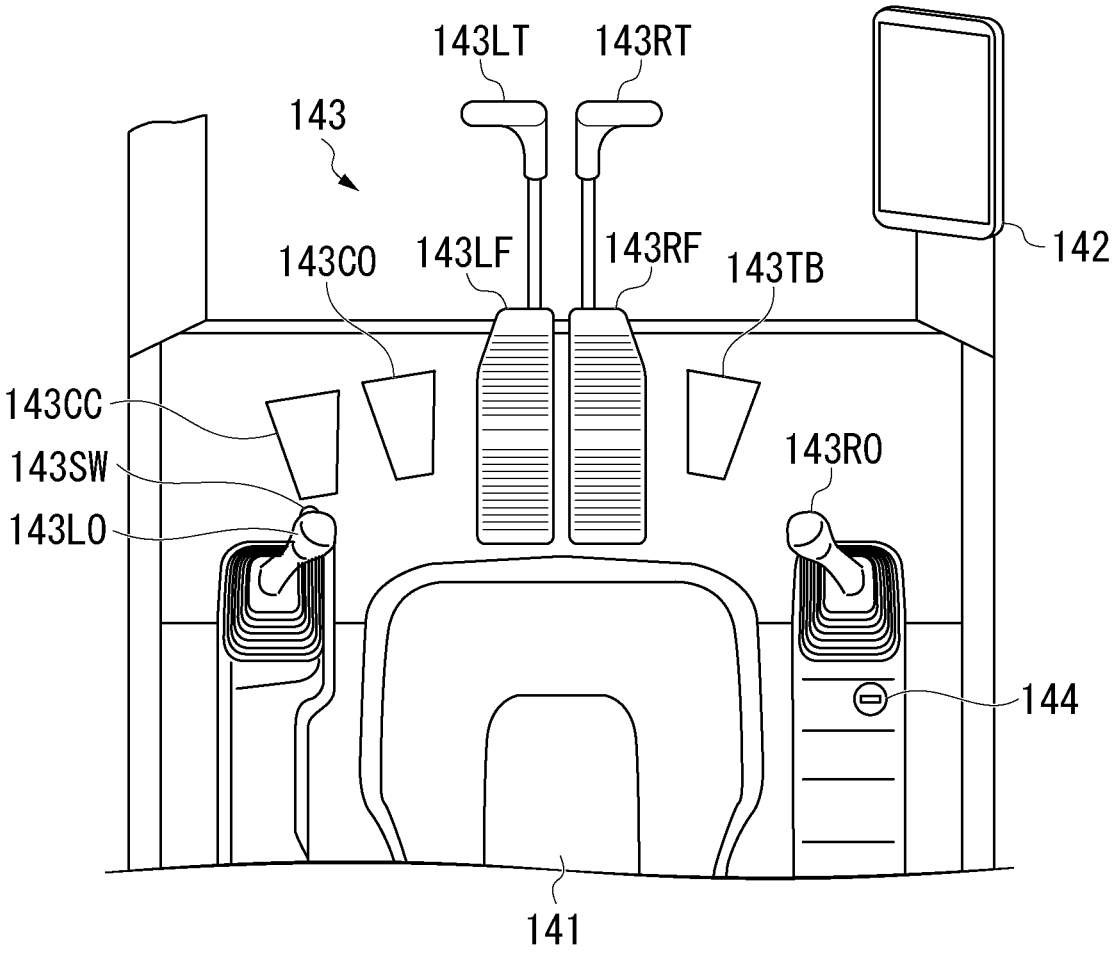
FIG. 2 is a view illustrating a configuration inside a cab according to the first embodiment.

FIG. 2 is a view illustrating a configuration inside the cab 140 according to the first embodiment.

A driver's seat 141, an operation terminal 142, and an operation device 143 are provided in the cab 140. The operation terminal 142 is provided in the vicinity of the driver's seat 141 and serves as a user interface with a control device 160 to be described later. The operation terminal 142 may receive an operation from the operator by, for example, a touch panel. Also, the operation terminal 142 may include a display unit such as an LCD. The touch panel is an example of a display unit.

The operation device 143 is a device for driving the undercarriage 110, the swing body 120, and the work equipment 130 by a manual operation of the operator. The operation device 143 includes a left operation lever 143LO, a right operation lever 143RO, a left foot pedal 143LF, a right foot pedal 143RF, a left travel lever 143LT, a right travel lever 143RT, a clam open pedal 143CO, a clam close pedal 143CC, a swing brake pedal 143TB, and a start switch 143SW.

The left operation lever 143LO is provided on the left side of the driver's seat 141. The right operation lever 143RO is provided on a right side of the driver's seat 141.

The left operation lever 143LO is an operating mechanism for performing a swing operation of the swing body 120 and an excavating/dumping operation of the arm 132. Specifically, when the operator of the loading machine 100 tilts the left operation lever 143LO forward, the arm 132 performs a dumping operation. Also, when the operator of the loading machine 100 tilts the left operation lever 143LO rearward, the arm 132 performs an excavating operation. Also, when the operator of the loading machine 100 tilts the left operation lever 143LO in a right direction, the swing body 120 swings rightward. Also, when the operator of the loading machine 100 tilts the left operation lever 143LO in a left direction, the swing body 120 swings leftward. Further, in another embodiment, a swing body 120 may swing rightward or leftward when a left operation lever 143LO is tilted in a front-rear direction, and an arm 132 may perform an excavating operation or a dumping operation when the left operation lever 143LO is tilted in a left-right direction.

The right operation lever 143RO is an operation mechanism for performing an excavating/dumping operation of the clam bucket 133 and raising/lowering operations of the boom 131. Specifically, when the operator of the loading machine 100 tilts the right operation lever 143RO forward, a lowering operation of the boom 131 is executed. Also, when the operator of the loading machine 100 tilts the right operation lever 143RO rearward, a raising operation of the boom 131 is executed. Also, when the operator of the loading machine 100 tilts the right operation lever 143RO in a right direction, a dumping operation of the clam bucket 133 is performed. Also, when the operator of the loading machine 100 tilts the right operation lever 143RO in a left direction, an excavating operation of the clam bucket 133 is performed. Further, in another embodiment, when the right operation lever 143RO is tilted in a front-rear direction, the clam bucket 133 may perform a dumping operation or an excavating operation, and when the right operation lever 143RO is tilted in a left-right direction, the boom 131 may perform a raising operation or a lowering operation.

The left foot pedal 143LF is disposed on a left side of a floor in the front of the driver's seat 141. The right foot pedal 143RF is disposed on a right side of the floor in the front of the driver's seat 141. The left travel lever 143LT is pivotally supported by the left foot pedal 143LF, and is configured so that an inclination of the left travel lever 143LT and a depression of the left foot pedal 143LF are interlocked. The right travel lever 143RT is pivotally supported by the right foot pedal 143RF, and is configured so that an inclination of the right travel lever 143RT and a depression of the right foot pedal 143RF are interlocked.

The left foot pedal 143LF and the left travel lever 143LT deal with a rotational drive of a left crawler track of the undercarriage 110. Specifically, when the operator of the loading machine 100 tilts the left foot pedal 143LF or the left travel lever 143LT forward, the left crawler track rotates in a forward direction. Also, when the operator of the loading machine 100 tilts the left foot pedal 143LF or the left travel lever 143LT rearward, the left crawler track rotates in a rearward direction.

The right foot pedal 143RF and the right travel lever 143RT deal with a rotational drive of a right crawler track of the undercarriage 110. Specifically, when the operator of the loading machine 100 tilts the right foot pedal 143RF or the right travel lever 143RT forward, the right crawler track rotates in a forward direction. Also, when the operator of the loading machine 100 tilts the right foot pedal 143RF or the right travel lever 143RT rearward, the right crawler track rotates in a rearward direction.

The clam open pedal 143CO and the clam close pedal 143CC are disposed on a left side of the left foot pedal 143LF. The clam open pedal 143CO is disposed adjacent to the right of the clam close pedal 143CC. When the clam open pedal 143CO is depressed, the clam bucket 133 opens at a speed in accordance with a depression amount. When the clam close pedal 143CC is depressed, the clam bucket 133 closes at a speed in accordance with a depression amount.

The swing brake pedal 143TB is disposed on a right side of the right foot pedal 143RF. When the swing brake pedal 143TB is depressed, a relief pressure of a hydraulic circuit connecting the control valve 123 and the swing motor 124 is increased. Specifically, when the swing brake pedal 143TB is depressed, a solenoid of a variable relief valve provided in the hydraulic circuit connecting the control valve 123 and the swing motor 124 is excited, and thereby the relief pressure of the variable relief valve is increased. Thereby, a braking force related to the swing can be increased.

The start switch 143SW is provided on, for example, a handle portion of the left operation lever 143LO. Further, the start switch 143SW may be disposed to be positioned in the vicinity of the operator seated on the driver's seat 141. When the start switch 143SW is depressed, an automatic loading instruction signal is output to the control device 160. The control device 160 starts an automatic loading control to be described later when it receives an input of the automatic loading instruction signal.

Configuration of Measurement System

As illustrated in FIG. 1, the loading machine 100 includes a position/azimuth direction calculator 151, an inclination measuring device 152, a boom angle sensor 153, an arm angle sensor 154, a bucket angle sensor 155, and a detection device 156.

The position/azimuth direction calculator 151 calculates a position of the swing body 120 and an azimuth direction in which the swing body 120 is directed. The position/azimuth direction calculator 151 includes two receivers that receive positioning signals from artificial satellites that form a global navigation satellite system (GNSS). The two receivers are installed at different positions on the swing body 120. The position/azimuth direction calculator 151 detects a position of a representative point (origin of an excavator coordinate system) of the swing body 120 in a field coordinate system on the basis of the positioning signals received by the receivers.

The position/azimuth direction calculator 151 uses the positioning signals received by the two receivers to calculate the azimuth direction in which the swing body 120 is directed as a relationship of an installation position of one receiver with respect to an installation position of the other receiver. The azimuth direction in which the swing body 120 is directed refers to a direction orthogonal to the front surface of the swing body 120 and is equal to a horizontal component of an extension direction of a straight line extending from the boom 131 to the clam bucket 133 of the work equipment 130.

The inclination measuring device 152 measures an acceleration and an angular velocity of the swing body 120 and detects a posture (for example, a roll angle, a pitch angle, and a yaw angle) of the swing body 120 on the basis of the measurement result. The inclination measuring device 152 is installed on, for example, a lower surface of the swing body 120. The inclination measuring device 152 can use, for example, an inertial measurement unit (IMU).

The boom angle sensor 153 is attached to the boom 131 and detects an inclination angle of the boom 131.

The arm angle sensor 154 is attached to the arm 132 and detects an inclination angle of the arm 132.

The bucket angle sensor 155 is attached to the backall 1331 of the clam bucket 133 and detects an inclination angle of the clam bucket 133.

The boom angle sensor 153, the arm angle sensor 154, and the bucket angle sensor 155 according to the first embodiment detect inclination angles with respect to a horizontal plane. Further, angle sensors according to another embodiment are not limited thereto, and may detect inclination angles with respect to another reference plane. For example, in another embodiment, the angle sensors may detect a relative rotation angle by a potentiometer provided at base end portions of the boom 131, the arm 132, and the clam bucket 133, or may measure cylinder lengths of the boom cylinder 131C, the arm cylinder 132C, and the bucket cylinder 133C to detect inclination angles by converting the cylinder lengths into angles.

The detection device 156 detects a three-dimensional position of an object present around the loading machine 100. A stereo camera, a laser scanner, an ultra wide band (UWB) ranging device, and the like can be mentioned as examples of the detection device 156. The detection device 156 is provided in, for example, an upper portion of the cab 140 so that a detection direction is directed forward. Further, the detection device 156 may be provided at any position as long as surroundings of the loading machine 100 can be imaged. For example, the detection device 156 may be provided on a side wall of the swing body 120 or the like outside the cab 140. Also, the detection direction may not be directed forward. The detection device 156 determines a three-dimensional position of an object in a coordinate system with a position of the detection device 156 as a reference. Further, the loading machine 100 according to another embodiment may include a plurality of detection devices 156.

Configuration of Control Device 160

Figure 3:
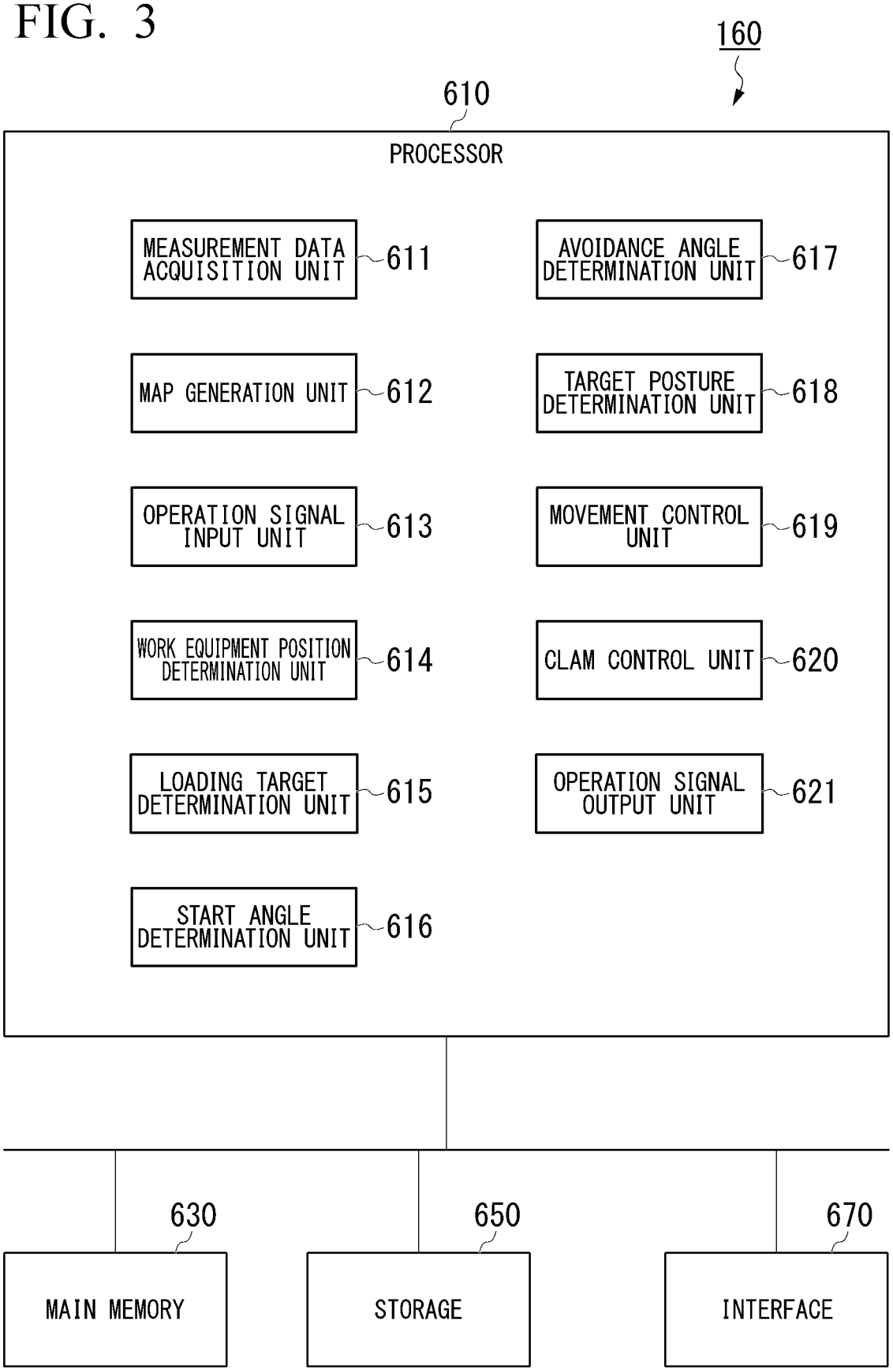
FIG. 3 is a schematic block diagram showing a configuration of a control device according to the first embodiment.

FIG. 3 is a schematic block diagram showing a configuration of the control device 160 according to the first embodiment.

The loading machine 100 includes the control device 160. The control device 160 may be mounted on the operation terminal 142, or may be provided separately from the operation terminal 142 and receive input/output from the operation terminal 142. The control device 160 receives an operation signal from the operation device 143. The control device 160 drives the work equipment 130, the swing body 120, and the undercarriage 110 by outputting a received operation signal or an operation signal for the automatic loading control generated by calculation to the control valve 123.

The control device 160 is a computer including a processor 610, a main memory 630, a storage 650, and an interface 670. The storage 650 stores a program. The processor 610 reads the program from the storage 650, deploys it in the main memory 630, and executes processing according to the program.

As examples of the storage 650, a semiconductor memory, a magnetic disk, a magneto-optical disk, an optical disk, and the like can be mentioned. The storage 650 may be internal media directly connected to a common communication line of the control device 160 or external media connected to the control device 160 via the interface 670. The main memory 630 and the storage 650 are non-transitory tangible storage media.

The processor 610 includes, by executing a program, a measurement data acquisition unit 611, a map generation unit 612, an operation signal input unit 613, a work equipment position determination unit 614, a loading target determination unit 615, a start angle determination unit 616, an avoidance angle determination unit 617, a target posture determination unit 618, a movement control unit 619, a clam control unit 620, and an operation signal output unit 621.

The measurement data acquisition unit 611 acquires measurement data from a measurement system of the loading machine 100. Specifically, the measurement data acquisition unit 611 acquires measurement data from the position/azimuth direction calculator 151, the inclination measuring device 152, the boom angle sensor 153, the arm angle sensor 154, the bucket angle sensor 155, and the detection device 156. The measurement data acquisition unit 611 calculates an angle of the swing body 120 by integrating an angular velocity of the swing body 120 measured by the inclination measuring device 152.

The map generation unit 612 generates map data showing surroundings of the loading machine 100 using the measurement data acquired from the detection device 156. The map generation unit 612 generates the map data by, for example, a simultaneous localization and mapping (SLAM) technology. The map data is expressed by a vehicle body coordinate system. The vehicle body coordinate system is an orthogonal coordinate system expressed by an axis extending in a front-rear direction, an axis extending in a left-right direction, and an axis extending in a vertical direction with the swing center of the swing body 120 as an origin. Since the detection device 156 is fixed to the swing body 120, the map generation unit 612 can generate map data of the vehicle body coordinate system by translating calculation results of the SLAM on the basis of a positional relationship between the swing center and the detection device 156. The map data generated by the map generation unit 612 is recorded in the main memory 630.

The operation signal input unit 613 receives an input of an operation signal from the operation device 143. The operation signal includes a rotation operation signal for the boom 131, a rotation operation signal for the arm 132, a rotation operation signal for the clam bucket 133, an open/close operation signal for the clam bucket 133, a swing operation signal for the swing body 120, a travel operation signal for the undercarriage 110, and an automatic loading instruction signal for the loading machine 100.

The work equipment position determination unit 614 determines a position P (FIG. 5) of a distal end of the arm 132 and a height H (FIG. 5) from the distal end of the arm 132 to a lowest point of the clam bucket 133 in a vehicle body coordinate system with the swing body 120 as a reference on the basis of the measurement data acquired by the measurement data acquisition unit 611. The lowest point of the clam bucket 133 refers to a point of an outer shape of the clam bucket 133 in which a distance from the ground level is the smallest.

The work equipment position determination unit 614 obtains a vertical direction component and a horizontal direction component of a length of the boom 131 on the basis of the inclination angle of the boom 131 and a known length of the boom 131 (a distance from a pin at the base end portion to a pin at the distal end portion). Similarly, the work equipment position determination unit 614 obtains a vertical direction component and a horizontal direction component of a length of the arm 132. The work equipment position determination unit 614 determines a position away from a position of the loading machine 100 in a direction determined by a direction and a posture of the loading machine 100 by a sum of the vertical direction components and a sum of the horizontal direction components of the lengths of the boom 131 and the arm 132 as the position P of the distal end of the arm 132. Also, on the basis of the inclination angle of the clam bucket 133 and a known shape of the clam bucket 133, the work equipment position determination unit 614 determines the lowest point in the vertical direction of the clam bucket 133, and determines the height H from the distal end of the arm 132 to the lowest point, and a horizontal distance D (FIG. 5) from the distal end of the arm 132 to the lowest point.

When the automatic loading instruction signal is input to the operation signal input unit 613, the loading target determination unit 615 determines a loading point on the basis of the map data generated by the map generation unit 612. The loading point refers to a position above the loading target T (for example, a dump body of the dump truck). In the automatic loading control, a dump control is started when the distal end of the arm 132 reaches the loading point. Specifically, the loading target determination unit 615 determines a position and shape of the loading target T from the map data and a known shape of the loading target T. For example, the loading target determination unit 615 determines a position of the loading target T by three-dimensional pattern matching. The loading target determination unit 615 determines the loading point on the basis of a center point of an upper surface of the determined loading target T and a shape of the clam bucket 133.

The start angle determination unit 616 determines an angle between an azimuth direction in which the swing body 120 is directed when the automatic loading instruction signal is input to the operation signal input unit 613 and an azimuth direction in which the loading point is present as a start angle. The azimuth direction in which the swing body 120 is directed when the automatic loading instruction signal is input can also be said to be an azimuth direction in which the swing body 120 is directed when the automatic loading control of the loading machine 100 is started. That is, the start angle determination unit 616 determines an angle formed by a line segment extending from the swing center of the swing body 120 to a position of the distal end of the arm 132 determined by the work equipment position determination unit 614 and a line segment extending from the swing center of the swing body 120 to the loading point when the automatic loading control is started as a start angle.

The avoidance angle determination unit 617 determines an interference avoidance angle on the basis of the position and shape of the loading target T determined by the loading target determination unit 615. The interference avoidance angle refers to a swing angle when the work equipment 130 and the loading target T do not interfere with each other in a plan view from above. Specifically, the avoidance angle determination unit 617 determines the interference avoidance angle by the following procedures.

The avoidance angle determination unit 617 determines a rearmost point $p_1$ (FIG. 5) of the outer shape of the loading target T in a swing direction of the swing body 120 on the basis of the position and shape of the loading target T determined by the loading target determination unit 615. The avoidance angle determination unit 617 obtains a first angle $\phi_1$ (FIG. 5) formed by a line segment extending from the swing center of the swing body 120 to the position of the distal end of the arm 132 and a line segment extending from the swing center of the swing body 120 to a point of the determined outer shape of the loading target T when the automatic loading control is started. The avoidance angle determination unit 617 determines a foremost point $p_2$ (FIG. 5) of the outer shape of the clam bucket 133 in the swing direction of the swing body 120 on the basis of the position of the distal end of the arm 132 determined by the work equipment position determination unit 614 and the known shape of the clam bucket 133. The avoidance angle determination unit 617 obtains a second angle $\phi_2$ formed by the line segment extending from the swing center of the swing body 120 to the position of the distal end of the arm 132 and a line segment extending from the swing center of the swing body 120 to a point of the determined outer shape of the clam bucket 133. The avoidance angle determination unit 617 obtains an interference avoidance angle $\theta_1$ (FIG. 5) by further subtracting a control margin angle $\phi_3$ from a difference between the first angle $\phi_1$ and the second angle $\phi_2$.

Figure 4:
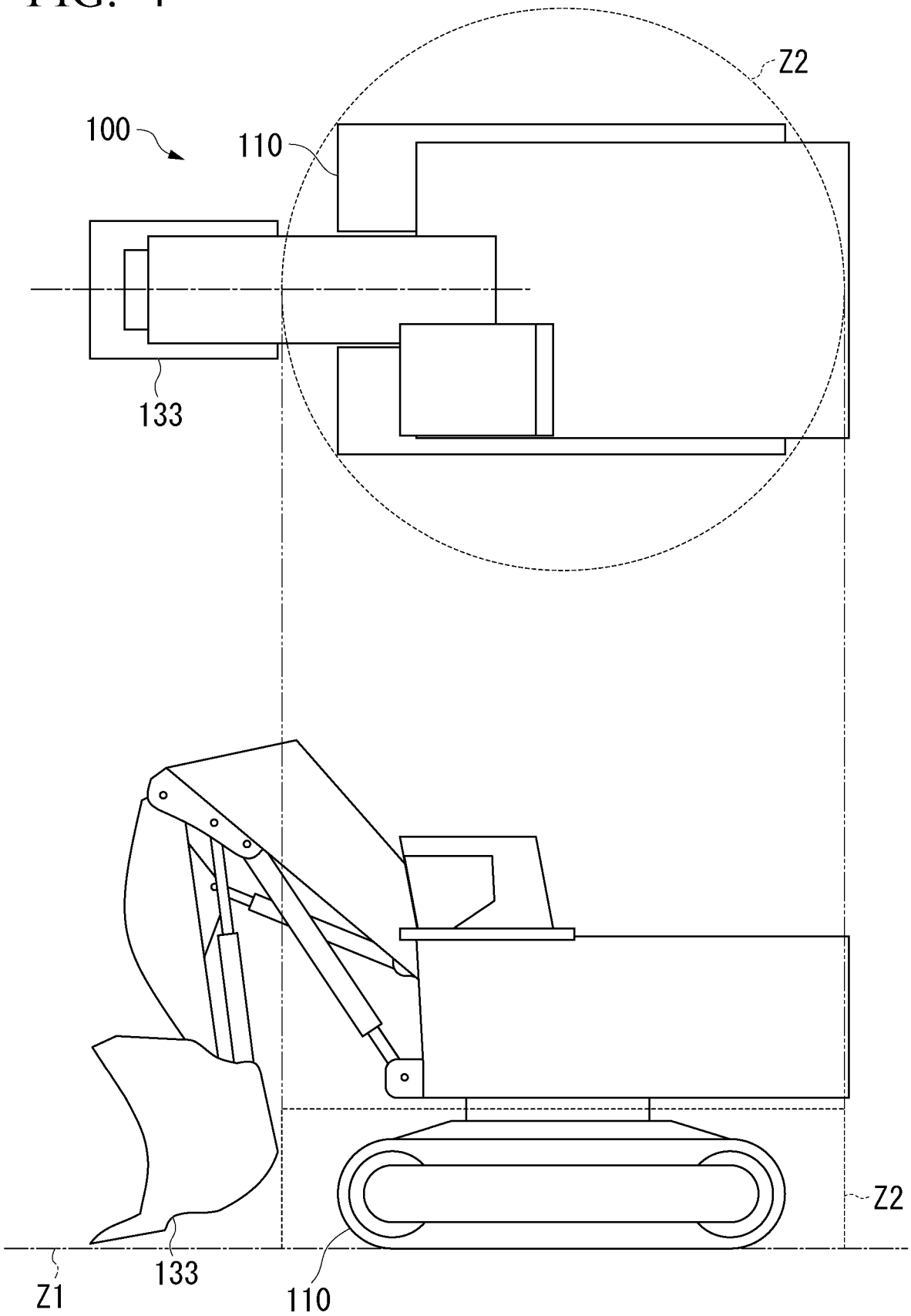
FIG. 4 is a view illustrating an example of a target posture of work equipment at the start of excavation according to the first embodiment.

The target posture determination unit 618 calculates a posture of the work equipment 130 when the distal end of the arm 132 is positioned at the loading point on the basis of a distance and a height from the swing center to the loading point determined by the loading target determination unit 615, and determines a target posture when the work equipment 130 starts to dump. Also, the target posture determination unit 618 determines a target posture of the work equipment 130 at the start of excavation by reading a predetermined target posture of the work equipment 130 at the start of excavation from the storage 650 or the main memory 630. FIG. 4 is a view illustrating an example of the target posture of the work equipment 130 according to the first embodiment at the start of excavation. The target posture at the start of excavation is a posture such that, for example, the clam bucket 133 approaches the undercarriage 110 to the extent that it does not interfere with the undercarriage 110, and a bottom surface of the clam bucket 133 approaches a plane Z1 including a bottom surface of the undercarriage 110 to the extent that it does not come into contact with the plane Z1. That is, the clam bucket 133 in the target posture at the start of excavation is positioned on an outward side from an interference prohibition region Z2 formed outside a virtual circular cylinder circumscribing the undercarriage 110 in terms of a distance from the swing center. Such a target posture is a posture that facilitates proceeding to subsequent excavation work. Further, the interference prohibition region Z2 is defined by a virtual circular cylinder instead of a rectangular parallelepiped corresponding to the undercarriage 110, and thereby a contact between the undercarriage 110 and the clam bucket 133 can be prevented when the swing body 120 swings. The bottom surface of the clam bucket 133 in the target posture at the start of excavation may be parallel to the plane Z1 or may form an acute angle with the plane Z1. The target posture is represented by, for example, positions of the distal end of the boom 131, the distal end of the arm 132, and the bucket teeth of the clam bucket 133 in the vehicle body coordinate system. Further, the posture of the work equipment 130 includes positions and angles of parts constituting the work equipment 130 in the vehicle body coordinate system.

When the operation signal input unit 613 has received an input of the automatic loading instruction signal, the movement control unit 619 shown in FIG. 3 generates an operation signal that realizes a combined movement of the swing body 120 and the work equipment 130 for moving the clam bucket 133 to the loading point on the basis of the loading point determined by the loading target determination unit 615 and the interference avoidance angle determined by the avoidance angle determination unit 617. Specifically, the movement control unit 619 generates an operation signal for driving the work equipment 130 so that the posture of the work equipment 130 reaches a target posture at the start of dumping determined by the target posture determination unit 618. Also, the movement control unit 619 adjusts a swing start timing so that the posture of the work equipment 130 reaches the target posture at the start of dumping before the swing angle reaches the interference avoidance angle. That is, when the swing body 120 has started swinging, and if the work equipment 130 does not reach the target posture before the swing angle due to the swing reaches the interference avoidance angle, the movement control unit 619 does not generate the swing operation signal for the swing body 120, and only generates the operation signal for the work equipment 130. On the other hand, if the work equipment 130 is determined to reach the target posture before the swing angle due to the swing reaches the interference avoidance angle, the movement control unit 619 generates the swing operation signal for the swing body 120 and the operation signal for the work equipment 130, and realizes the combined movement of the swing body 120 and the work equipment 130.

Also, after the distal end of the arm 132 has reached the loading point, the movement control unit 619 generates an operation signal for driving the swing body 120 and the work equipment 130 so that the swing body 120 swings to the start angle determined by the start angle determination unit 616 and the posture of the work equipment 130 reaches the target posture at the start of excavation determined by the target posture determination unit 618.

The clam control unit 620 generates an operation signal for opening the clam bucket 133 when the distal end of the arm 132 reaches the loading point. Also, the clam control unit 620 generates an operation signal for closing the clam bucket 133 when the swing angle of the swing body 120 exceeds a difference between the start angle and the interference avoidance angle. Further, even before the distal end of the arm 132 reaches the loading point, the clam control unit 620 may generate an operation signal for opening the clam bucket 133 when the clam bucket 133 and the loading target T overlap in a plan view from above. The clam control unit 620 is an example of a dump control unit.

The operation signal output unit 621 outputs the operation signal that has been input to the operation signal input unit 613 or the operation signal generated by the movement control unit 619. Specifically, the operation signal output unit 621 outputs the operation signal generated by the movement control unit 619 during the automatic loading control, and outputs the operation signal that has been input to the operation signal input unit 613 when not in the automatic loading control.

<<Operation During Automatic Loading Control>>

Here, movement of the loading machine 100 during the automatic loading control according to the first embodiment will be described with reference to the drawings.

Figure 5:
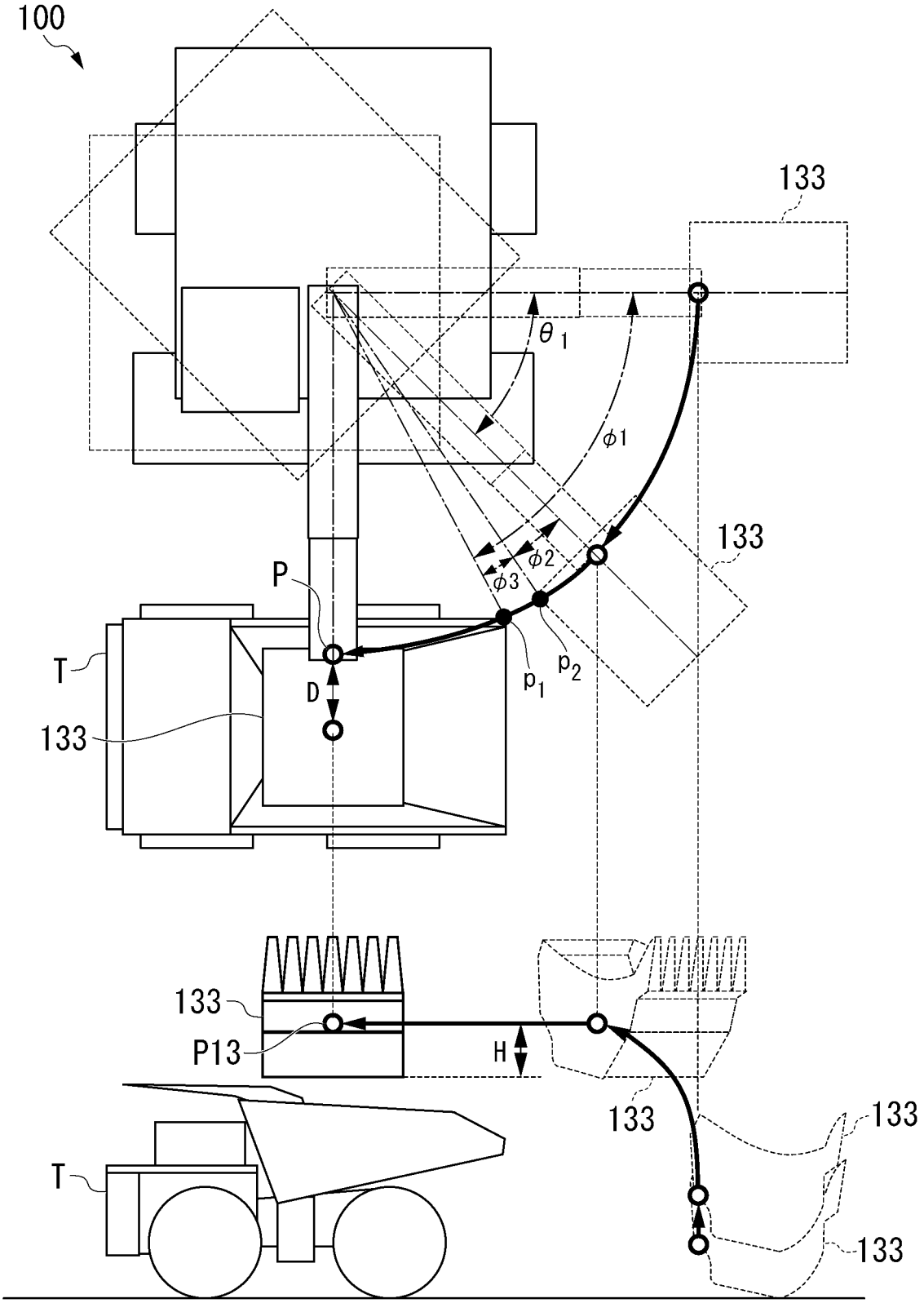
FIG. 5 is a view illustrating an example of movement of the loading machine from the start of automatic loading control to the start of dumping according to the first embodiment.
Figure 6:
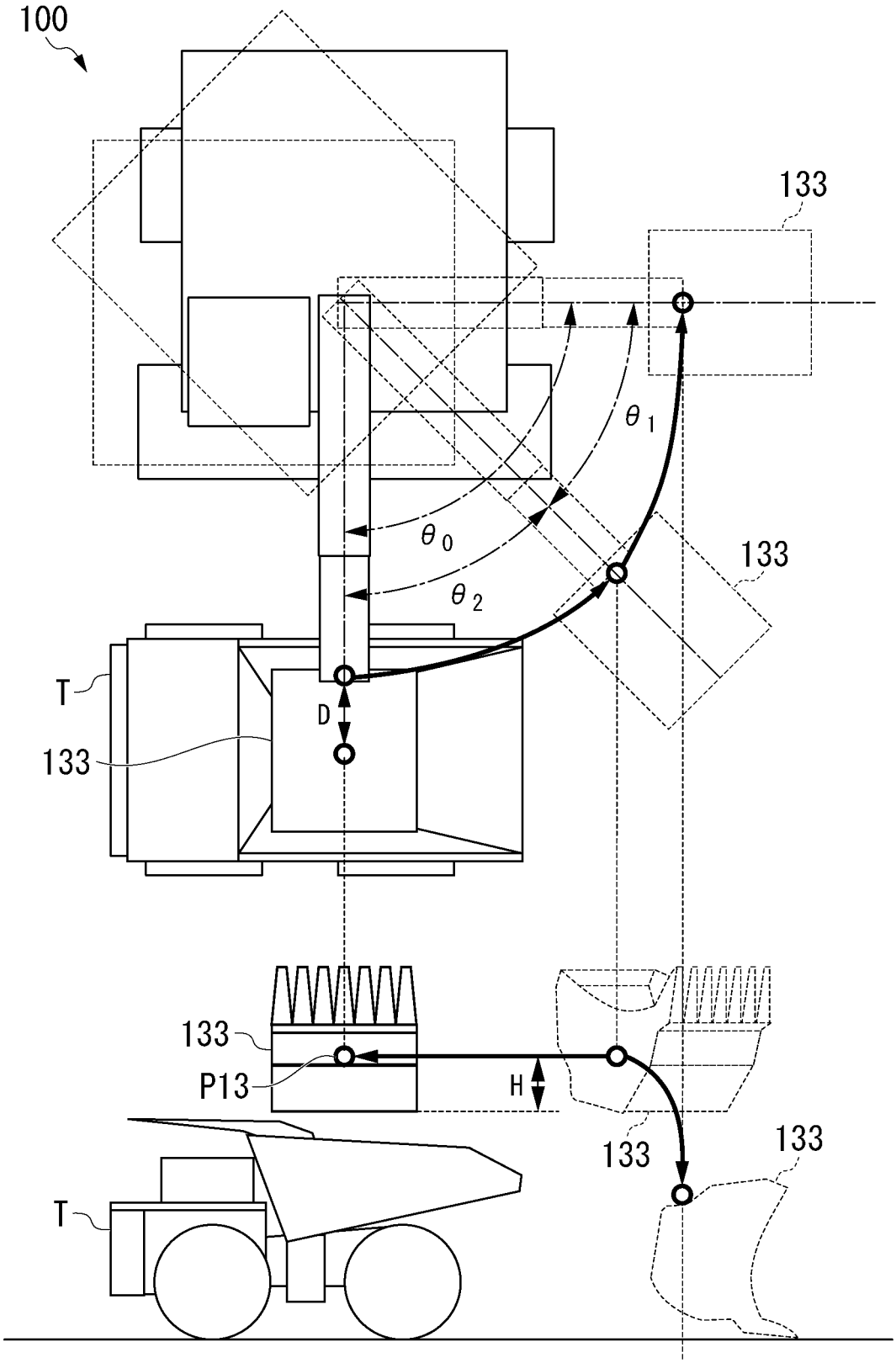
FIG. 6 is a view illustrating an example of movement of the loading machine from the start of dumping to the end of the automatic loading control according to the first embodiment.

FIG. 5 is a view illustrating an example of movement of the loading machine 100 from the start of the automatic loading control to the start of dumping according to the first embodiment. FIG. 6 is a view illustrating an example of movement of the loading machine 100 from the start of dumping to the end of the automatic loading control according to the first embodiment.

The automatic loading control according to the first embodiment is started when the start switch 143SW is depressed in a state in which the work equipment 130 has excavated earth, which is an object to be excavated, by a manual operation by the operator and the earth is held in the clam bucket 133. When the automatic loading control is started, the loading machine 100 dumps the earth above the loading target T, and moves the work equipment 130 to a subsequent excavation start point. In the first embodiment, at the end of the automatic loading control, the swing body 120 is directed in a direction in which the automatic loading control has been started to facilitate subsequent excavation processing. Also, in order to facilitate the subsequent excavation processing, the work equipment 130 is placed in a posture in which the bottom surface of the clam bucket 133 is lowered close to the ground and the clam bucket 133 is brought closer to a vehicle body side.

Specifically, when the automatic loading control is started, the control device 160 first starts driving of the work equipment 130 (the boom 131, the arm 132, and the clam bucket 133) and moves the clam bucket 133 upward as illustrated in FIG. 5. After a delay, the control device 160 causes the swing body 120 to start swinging. The control device 160 adjusts a swing start timing so that the posture of the work equipment 130 reaches the target posture at the start of dumping before the swing angle of the swing body 120 becomes the same as the interference avoidance angle $\theta_1$. Hereinafter, the interference avoidance angle $\theta_1$ is also referred to as a first interference avoidance angle $\theta_1$. Further, if the posture of the work equipment 130 reaches the target posture at the start of dumping before the swing angle of the swing body 120 becomes the same as the first interference avoidance angle $\theta_1$, that is, when a height of the lowest point of the clam bucket 133 is higher than the upper surface of the loading target T, the work equipment 130 does not come into contact with the loading target T due to the swing of the swing body 120. Thereafter, when the distal end of the arm 132 reaches the loading point, the control device 160 opens the clam bucket 133 and starts dumping.

After a certain period of time has elapsed since the start of dumping, the control device 160 causes the swing body 120 to start swinging as illustrated in FIG. 6. The control device 160 does not start driving of the work equipment 130 until the swing angle of the swing body 120 exceeds an angle $\theta_2$ which is a difference between a start angle θ0 and the interference avoidance angle $\theta_1$. Hereinafter, the angle $\theta_2$ is also referred to as a second interference avoidance angle $\theta_2$. When the swing angle of the swing body 120 exceeds the second interference avoidance angle $\theta_2$, the control device 160 starts driving of the work equipment 130. When the swing angle of the swing body 120 reaches the start angle $\theta_0$, the control device 160 ends driving of the swing body 120. Also, when the posture of the work equipment 130 reaches the target posture at the start of excavation, the control device 160 ends driving of the work equipment 130.

Figure 7:
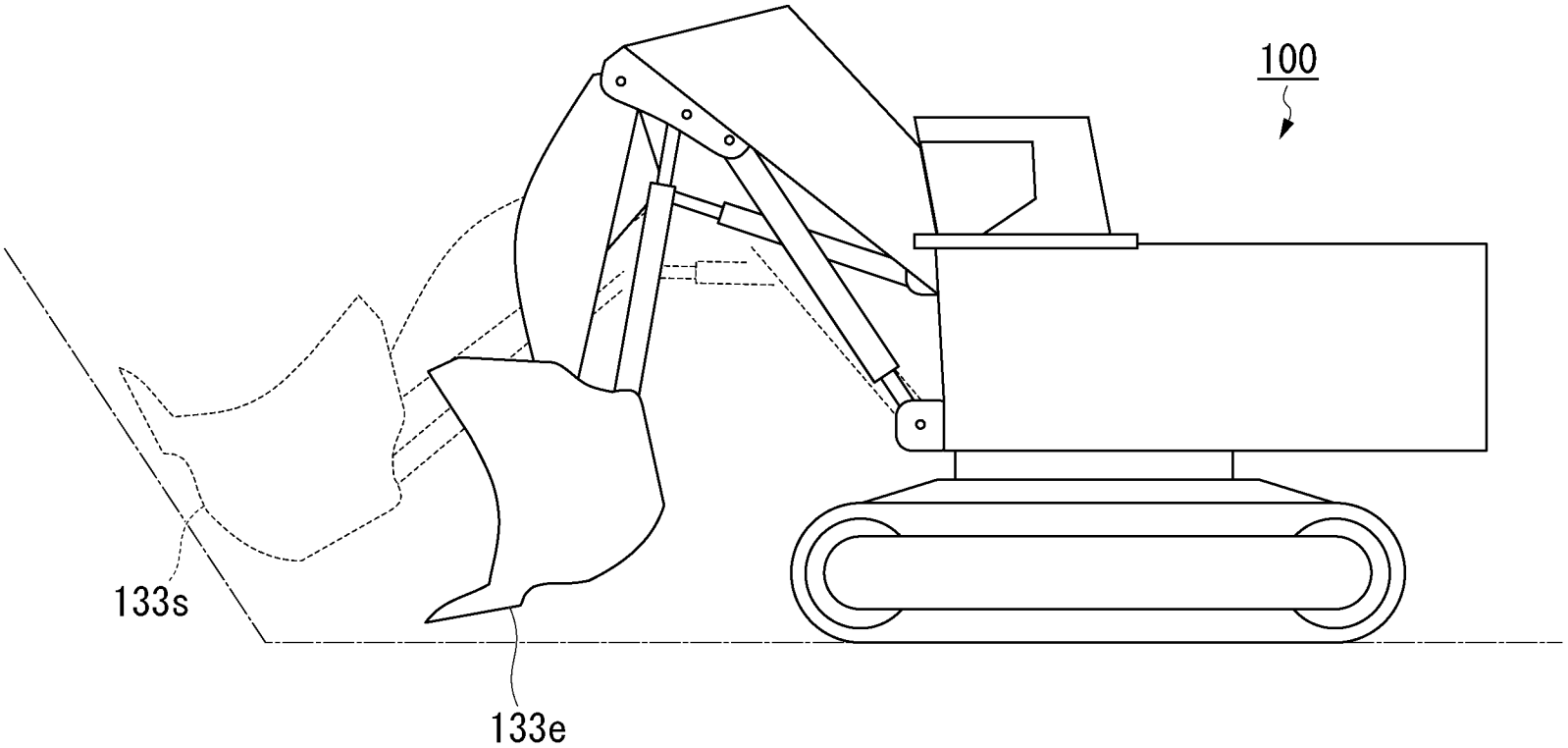
FIG. 7 is a view comparing a posture of the work equipment at the start of the automatic loading control and a posture of the work equipment at the end of the automatic loading control in the first embodiment.

FIG. 7 is a view comparing a posture of the work equipment 130 at the start of the automatic loading control and a posture of the work equipment 130 at the end of the automatic loading control in the first embodiment. The automatic loading control is started in a state in which the work equipment 130 excavates earth and the earth is held in the clam bucket 133. Therefore, a posture 133*s* of the clam bucket 133 at the start of the automatic loading control is a posture with the bucket teeth facing upward above the object to be excavated. In order to excavate the object to be excavated, since it is necessary to scoop it up from below with the bucket teeth facing the object to be excavated, a position and posture of the clam bucket 133 need to be changed to start the excavation work from the posture 133*s* of the clam bucket 133 at the start of the automatic loading control. On the other hand, a posture 133*e* of the clam bucket 133 at the end of the automatic loading control, that is, a target posture at the start of excavation, is a posture with the bucket teeth facing forward at a height close to the ground level. Thereby, the operator can easily transfer to the subsequent excavation work by setting the posture of the clam bucket 133 to the target posture at the start of excavation when the automatic loading control ends.

Operation of Control Device 160

Figure 8:
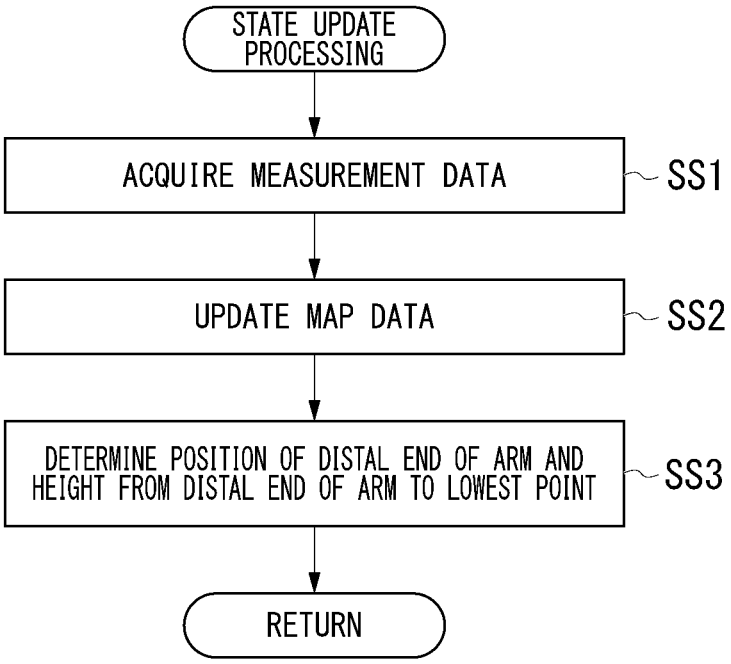
FIG. 8 is a flowchart showing an operation of the control device according to the first embodiment.

FIG. 8 is a flowchart showing an operation of the control device 160 according to the first embodiment.

The control device 160 of the loading machine 100 performs state update processing shown in FIG. 8 at regular control cycles during operation.

The measurement data acquisition unit 611 acquires measurement data from the position/azimuth direction calculator 151, the inclination measuring device 152, the boom angle sensor 153, the arm angle sensor 154, the bucket angle sensor 155, and the detection device 156 (step SS1). The map generation unit 612 updates the map data recorded in the main memory 630 using the measurement data that have been acquired from the detection device 156 in step SS1 (step SS2). Thereby, the control device 160 can always keep a latest state of the map data representing a situation in the vicinity of the loading machine 100 so that a latest position of the loading target T appears in the map data.

The work equipment position determination unit 614 determines the position P of the distal end of the arm 132 and the height H from the distal end of the arm 132 to the lowest point of clam bucket 133 in the vehicle body coordinate system with the swing body 120 as a reference on the basis of the measurement data acquired in step SS1 (step SS3).

Thereby, the control device 160 can constantly determine a current posture of the work equipment 130.

Figure 9:
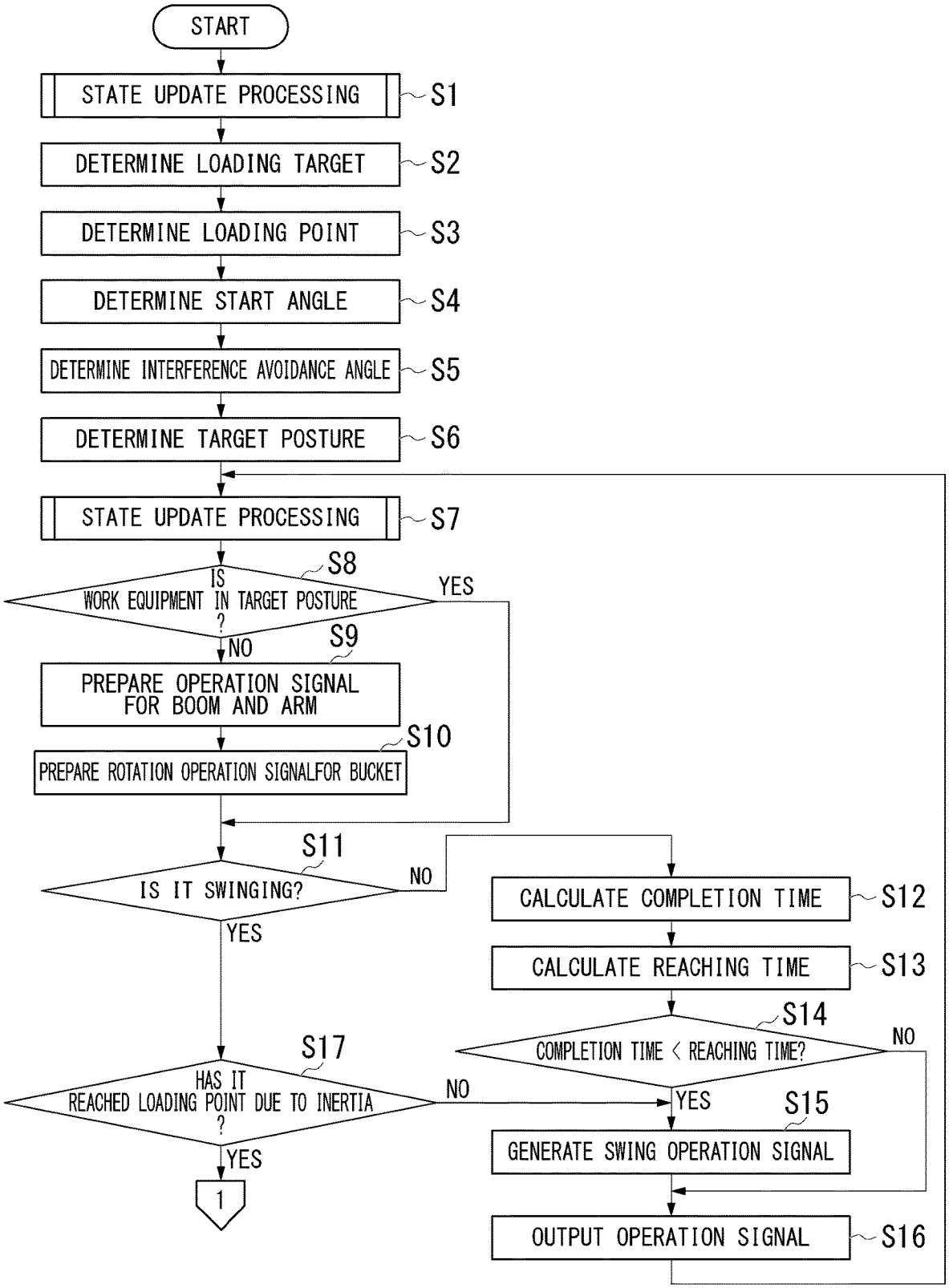
FIG. 9 is a flowchart showing an operation of the control device from the start of the automatic loading control to the start of dumping according to the first embodiment.
Figure 10:
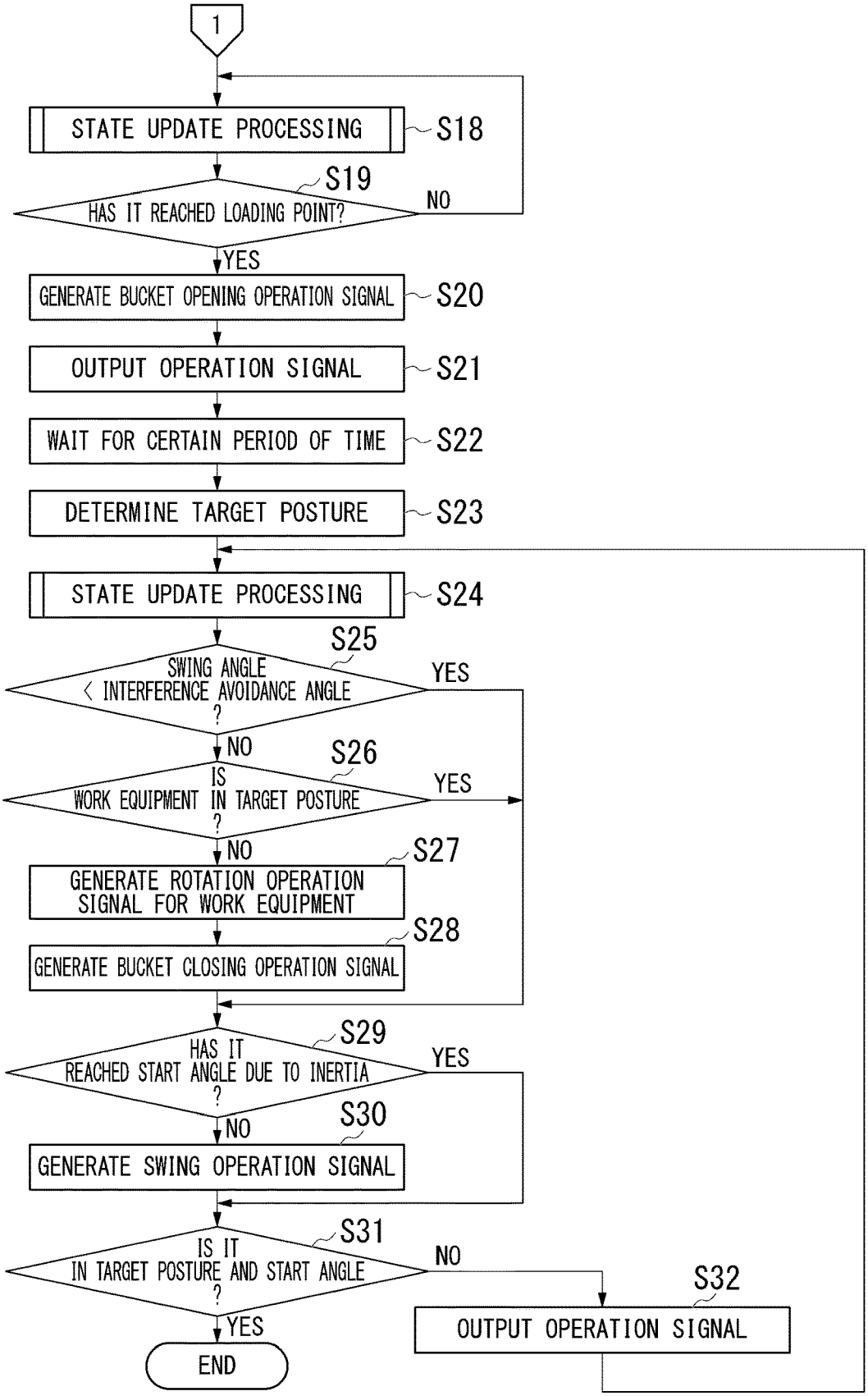
FIG. 10 is a flowchart showing an operation of the control device from the start of dumping to the end of the automatic loading control according to the first embodiment.

FIG. 9 is a flowchart showing an operation of the control device 160 from the start of the automatic loading control to the start of dumping according to the first embodiment. FIG. 10 is a flowchart showing an operation of the control device 160 from the start of dumping to the end of the automatic loading control according to the first embodiment.

When the start switch 143SW is depressed by the operator, the operation signal input unit 613 of the control device 160 receives an input of the automatic loading instruction signal. The control device 160 starts the automatic loading control from step SS1 in FIG. 8 with the automatic loading instruction signal as a trigger.

The control device 160 updates the measurement data, the map data, and the posture of the work equipment 130 to a latest state by the state update processing shown in FIG. 8 (step S1). The loading target determination unit 615 determines the position and shape of the loading target T on the basis of the map data updated in step S1 (step S2). The loading target determination unit 615 determines the loading point on the basis of the position of the loading target T determined in step S2 and the height H from the distal end of the arm 132 to the lowest point of the clam bucket 133 determined in step S1 (step S3).

The start angle determination unit 616 determines the start angle $\theta_0$ on the basis of the position of the loading point in the map data determined in step S3 (step S4). Since the map data is expressed by the vehicle body coordinate system, the start angle determination unit 616 determines, for example, an angle of a position vector of the loading point with respect to a coordinate axis extending forward of the swing body 120 as the start angle $\theta_0$. The avoidance angle determination unit 617 determines the first interference avoidance angle $\theta_1$ on the basis of the position and shape of the loading target T determined in step S2 (step S5). The target posture determination unit 618 determines postures of the boom 131 and the arm 132 when the distal end of the arm 132 is positioned at the loading point as the target posture (step S6).

Next, the control device 160 updates the measurement data, the map data, and the posture of the work equipment 130 to the latest state by the state update processing shown in FIG. 8 (step S7). Next, the movement control unit 619 determines whether or not the posture of the work equipment 130 determined in step S7 approximates the target posture determined in step S6 (step S8). For example, when a difference between the position of the distal end of the arm 132 in the target posture and a current position of the distal end of the arm 132 is equal to or less than a predetermined value, the movement control unit 619 determines that the posture of the work equipment 130 approximates the target posture.

If the posture of the work equipment 130 does not approximate the target posture (step S8: NO), the movement control unit 619 generates an operation signal for bringing the boom 131 and the arm 132 closer to the target posture (step S9). At this time, the movement control unit 619 generates the operation signal on the basis of positions and speeds of the boom 131 and the arm 132 determined in step S7.

Also, the movement control unit 619 calculates a sum of angular velocities of the boom 131 and the arm 132 on the basis of the generated operation signals for the boom 131 and the arm 132, and generates an operation signal for rotating the clam bucket 133 at the same speed as the sum of the angular velocities (step S10). Thereby, the movement control unit 619 can generate an operation signal for holding a ground angle of the clam bucket 133.

The movement control unit 619 determines whether or not the work equipment 130 is swinging (step S11). The movement control unit 619 determines that the swing body 120 is swinging when, for example, a swing speed is equal to or higher than a predetermined speed. If the work equipment 130 is not swinging (step S11: NO), the movement control unit 619 calculates a completion time until the work equipment 130 reaches the target posture on the basis of the speeds of the boom 131 and the arm 132 determined in step S7 (step S12). Also, the movement control unit 619 calculates a reaching time until the swing angle reaches the first interference avoidance angle $\theta_1$ determined in step S5 when the swing body 120 has started swinging (step S13). The movement control unit 619 determines whether or not the completion time calculated in step S12 is less than the reaching time calculated in step S13 (step S14). That is, the movement control unit 619 determines whether or not the work equipment 130 reaches the target posture when the swing angle reaches the first interference avoidance angle $\theta_1$.

If the completion time is equal to or more than the reaching time (step S14: NO), that is, when the work equipment 130 does not reach the target posture before the swing angle reaches the first interference avoidance angle $\theta_1$, the movement control unit 619 does not generate the swing operation signal for the swing body 120. On the other hand, if the completion time is less than the reaching time (step S14: YES), that is, when the work equipment 130 reaches the target posture before the swing angle reaches the first interference avoidance angle $\theta_1$, the movement control unit 619 generates the swing operation signal for the swing body 120 (step S15). Thereby, the control device 160 can prevent the work equipment 130 from coming into contact with the loading target T.

Then, the operation signal output unit 621 outputs the operation signal generated in at least one of steps S9, S10, and S15 to the control valve 123 (step S16). Thereby, the loading machine 100 is thereby driven. Then, the control device 160 returns the processing to step S7 and continues the control.

On the other hand, if it is determined in step S11 that the work equipment 130 is swinging (step S11: YES), when the operation signal for the swing has stopped on the basis of the swing speed of the work equipment 130 determined in step S7, the movement control unit 619 determines whether or not the distal end of the arm 132 reaches the loading point due to inertial swing (step S17). If the distal end of the arm 132 does not reach the loading point due to the inertial swing (step S17: NO), the movement control unit 619 generates the swing operation signal in step S15, and the operation signal output unit 621 outputs the swing operation signal to the control valve 123 in step S16.

On the other hand, if it is determined that the distal end of the arm 132 reaches the loading point due to the inertial swing (step S17: YES), the control device 160 updates the measurement data, the map data, and the posture of the work equipment 130 to the latest state due to the state update processing shown in FIG. 8 (step S18 in FIG. 10). The movement control unit 619 determines whether or not the distal end of the arm 132 has reached the loading point on the basis of the map data updated in step S18 (step S19). If the distal end of the arm 132 has not reached the loading point (step S19: NO), the control device 160 returns the processing to step S18 and waits for the distal end of the arm 132 to reach the loading point.

If the distal end of the arm 132 has reached the loading point (step S19: YES), the clam control unit 620 generates an opening operation signal for the clam bucket 133 (step S20). The operation signal output unit 621 outputs the opening operation signal generated in step S20 to the control valve 123 (step S21). The clam control unit 620 waits for the elapse of a certain period of time after outputting the opening operation signal for the clam bucket 133 (step S22). This time is a time required for a certain amount of earth to fall from the open clam bucket 133. Further, this time may be shorter than a time required for all the earth to fall from the clam bucket 133.

After a certain period of time, the target posture determination unit 618 reads a predetermined target posture of the work equipment 130 at the start of excavation from the storage 650 or the main memory 630, thereby determining the target posture of the work equipment 130 at the start of excavation (step S23). The target posture at the start of excavation is a posture such that, for example, the clam bucket 133 approaches the undercarriage 110 to the extent that it does not interfere with the undercarriage 110, and the clam bucket 133 approaches a plane passing through the bottom surface of the undercarriage 110 to the extent that it does interfere with the plane.

Next, the control device 160 updates the measurement data, the map data, and the posture of the work equipment 130 to the latest state by the state update processing shown in FIG. 8 (step S24). Next, the movement control unit 619 determines whether or not the swing angle of the swing body 120 from the start of dumping to the present time is less than the second interference avoidance angle $\theta_2$ which is a difference between the start angle $\theta_0$ and the first interference avoidance angle $\theta_1$ (step S25). If the swing angle is less than the second interference avoidance angle $\theta_2$ (step S25: YES), since the work equipment 130 may come into contact with the loading target T, the movement control unit 619 generates the operation signal (neutral signal) for maintaining the posture of the work equipment 130.

In step S25, if the swing angle is equal to or larger than the second interference avoidance angle $\theta_2$ (step S25: NO), the movement control unit 619 determines whether or not the posture of the work equipment 130 determined in step S24 approximates the target posture determined in step S23 (step S26). If the posture of the work equipment 130 does not approximate the target posture (step S26: NO), the movement control unit 619 generates the operation signal for bringing the boom 131, the arm 132, and the clam bucket 133 closer to the target posture (step S27). Also, the clam control unit 620 also generates a closing operation signal for the clam bucket (step S28). If the posture of the work equipment 130 approximates the target posture (step S26: YES), the movement control unit 619 does not generate the operation signal for the work equipment 130.

Also, when the operation signal for the swing has stopped on the basis of the swing speed of the work equipment 130 determined in step S24, the movement control unit 619 determines whether or not the distal end of the arm 132 can swing to the start angle $\theta_0$ determined in step S4 due to inertial swing (step S29). If the distal end of the arm 132 cannot swing to the start angle $\theta_0$ due to the inertial swing (step S29: NO), the movement control unit 619 generates a swing operation signal (step S30). On the other hand, if the distal end of the arm 132 can swing to the start angle $\theta_0$ due to the inertial swing (step S29: YES), the movement control unit 619 does not generate the swing operation signal.

Next, the operation signal output unit 621 determines whether or not the posture of the work equipment 130 approximates the target posture and the swing angle of the swing body 120 has reached the start angle $\theta_0$ (step S31). If the posture of the work equipment 130 does not approximate the target posture or the swing angle of the swing body 120 is less than the start angle $\theta_0$ (step S31: NO), the operation signal output unit 621 outputs the operation signals generated in steps S27, S28, and S30 to the control valve 123 (step S32). Then, the control device 160 returns the processing to step S24 and continues the control.

On the other hand, when the posture of the work equipment 130 approximates the target posture and the swing angle of the swing body 120 has reached the start angle $\theta_0$ (step S31: YES), the control device 160 ends the automatic loading control.

Operation and Effects

As described above, the control device 160 according to the first embodiment determines the start angle $\theta_0$ which is an angle of the swing body 120 at the start of the automatic loading control, drives the swing body 120 until the angle of the swing body 120 reaches the start angle $\theta_0$ after the clam bucket 133 has reached the loading point, and drives the work equipment 130 until the posture of the work equipment 130 reaches a preset target posture different from the posture of the work equipment 130 at the start of the automatic loading control. Since the posture of work equipment 130 at the start of the automatic loading control is normally a posture immediately after excavation, there is a high likelihood that the posture will not be suitable for excavation. Normally, since the clam bucket 133 after excavation has an opening thereof facing upward to hold earth, the bucket teeth are in a state of facing upward. On the other hand, in order to excavate earth, the bucket teeth are preferably directed toward the earth. Therefore, according to the first embodiment, the control device 160 can bring the clam bucket 133 into an appropriate posture for starting excavation after the automatic loading control by driving the clam bucket 133 until it reaches a preset target posture different from the posture of the clam bucket 133 at the start of the automatic loading control.

Further, a position of the clam bucket 133 indicated by the target posture in the first embodiment is positioned on an outward side from the interference prohibition region Z2. That is, the position of the clam bucket 133 indicated by the target posture is a position that does not interfere with a circumscribed circle of the undercarriage 110. Thereby, the control device 160 can prevent the clam bucket 133 from coming into contact with the undercarriage 110 when the control device 160 controls the work equipment 130 to reach the target posture.

Also, the control device 160 according to the first embodiment outputs the opening operation signal after the clam bucket 133 has reached the loading point, and outputs the swing operation signal for the swing body 120 before outputting the closing operation signal for the clam bucket 133. Thereby, the control device 160 can reduce a cycle time for the subsequent excavation operation.

Another Embodiment

As described above, although the embodiment of the present invention has been described in detail with reference to the drawings, the specific configurations are not limited to those described above, and various design or changes or the like can be made. That is, in another embodiment, the order of the processing described above may be changed as appropriate. Also, some of the processing may be executed in parallel.

The control device 160 according to the above-described embodiment may be configured by a single computer, or the configuration of the control device 160 may be disposed by being divided into a plurality of computers and the plurality of computers may function as the control device 160 in cooperation with each other. At this time, a part of the computers constituting the control device 160 may be mounted inside the loading machine 100, and the other computers may be provided outside the loading machine 100.

The loading machine 100 according to the above-described embodiment is a face excavator, but the present invention is not limited thereto. For example, a loading machine 100 according to another embodiment may be a backhoe. Further, if the loading machine 100 is a backhoe, a target posture of work equipment 130 at the start of excavation differs from that in the first embodiment. Since the backhoe performs excavation by pulling the work equipment 130 to the near side thereof, a position of a bucket related to the target posture at the start of excavation is preferably away from a swing body 120. For example, the loading machine 100 may set a posture, in which a shape of an object to be excavated is determined from map data, a position of the bucket is moved away from the swing body 120 to come close to the object to be excavated, and bucket teeth have an angle facing the object to be excavated, as the target posture at the start of excavation.

The loading machine 100 according to the above-described embodiment has the clam bucket 133, but the present invention is not limited thereto. For example, the loading machine 100 according to another embodiment may include an ordinary bucket. In this case, the loading machine 100 has a dump control unit instead of the clam control unit 620. The dump control unit outputs a rotation operation signal in a dump direction instead of the opening operation signal. Further, in order to shorten a cycle time, the control device 160 may output a swing operation signal for the swing body 120 while the rotation operation signal in the dump direction is being output.

The target posture according to the above-described embodiment is set in advance and recorded in the main memory 630 or the storage 650, but the present invention is not limited thereto. For example, the loading machine 100 according to another embodiment may be configured such that the target posture can be changed by operating an operation terminal 142. For example, the loading machine 100 according to another embodiment may change the target posture by inputting numerical values representing positions and angles of a boom 131, an arm 132, and a clam bucket 133 to the operation terminal 142. Also, in the loading machine 100 according to another embodiment, a work equipment position determination unit 614 may determine a posture of the work equipment 130 and update the target posture with the above-described target posture by operating the operation terminal 142 after controlling the work equipment 130 to a preferable posture by an operation of an operator.

The control device 160 according to the above-described embodiment determines the loading target on the basis of map data of the SLAM based on the measurement data of the detection device 156, but the present invention is not limited thereto. For example, the control device 160 according to another embodiment may calculate a position and shape of the loading target in the vehicle body coordinate system from the measurement results of a position/azimuth direction calculator 151 by receiving an input of latitude, longitude, and an azimuth direction of the loading target. Also, the control device 160 according to another embodiment may control the loading machine 100 on the basis of a global coordinate system represented by latitude, longitude, and an altitude instead of the vehicle body coordinate system. In this case, the control device 160 may calculate angles such as a start angle and a swing angle as angles relative to a reference azimuth direction of the global coordinate system.

The control device 160 according to the above-described embodiment calculates an angle of the swing body 120 by integrating an angular velocity of the swing body 120 measured by the inclination measuring device 152, but the present invention is not limited thereto. For example, the control device 160 according to another embodiment may calculate an angle of the swing body 120 on the basis of a difference in azimuth direction measured by the position/azimuth direction calculator 151. Also, in another embodiment, the angle of the swing body 120 may be determined using a detection value of a rotation angle sensor provided in a swing motor 124.

The control device 160 according to the above-described embodiment performs the automatic loading control on the basis of a comparison between the swing angle and the interference avoidance angle, but the present invention is not limited thereto. For example, the control device 160 according to another embodiment may perform the automatic loading control on the basis of a comparison between a position of the clam bucket 133 and a rearmost point $p_1$ (FIG. 5) of an outer shape of a loading target T in a swing direction of the swing body 120. For example, the control device 160 according to another embodiment may adjust a swing start timing so that the clam bucket 133 is positioned in a region in the vicinity of the point $p_1$.

The loading machine 100 according to the above-described embodiment is directly operated by the operator who is on board the cab 140, but the present invention is not limited thereto. For example, the loading machine 100 according to another embodiment may be one operated by a remote operation. That is, in another embodiment, an operation signal may be transmitted to the control device 160 by communication from an operation device 143 provided remotely.

The automatic loading control according to the above-described embodiment has been configured such that the clam bucket 133 is moved from the position at the completion of excavation to the loading point and then is moved to the position for starting the subsequent excavation, but the present invention is not limited thereto. For example, in another embodiment, the clam bucket 133 may be moved from a position at the completion of excavation to a loading point by a manual operation and damping is performed, and only movement of the loading machine 100 from the loading point to a position for starting the subsequent excavation may be automatically controlled. In this case, after the clam bucket 133 has reached the loading point, the operator may output a signal for driving the work equipment to the position for starting the subsequent excavation to the control device 160 by operating a switch provided in an operation lever or the like. The control device 160 controls the work equipment 130 according to the signal from the switch described above so that a posture of the work equipment 130 becomes a preset target posture different from that at the start of excavation as in the case of the automatic loading control according to the above-described embodiment.

The control device 160 according to the above-described embodiment controls the work equipment 130 on the basis of the position P of the distal end of the arm 132, but the position P of the distal end of the arm 132 may be a center of the distal end of the arm 132 or may be a position shifted to the left or right. Also, in another embodiment, the work equipment 130 may be controlled on the basis of an arbitrary position of the clam bucket 133 instead of the position P of the distal end of the arm 132.

INDUSTRIAL APPLICABILITY

The control device of the loading machine can move the bucket to an appropriate position for starting excavation due to automatic control of the loading machine.

The invention claimed is:

1. A control device for a loading machine, the loading machine including a swing body configured to swing around a swing center, a support part supporting the swing body, and work equipment including a bucket and attached to the swing body, the control device comprising:

a processor configured to:

determine a start angle of the swing body for a start of an automatic loading control of the loading machine, start the automatic loading control in a state in which the work equipment excavates an object and the bucket holds an excavated part of the object, generate an operation signal for driving the swing body and the work equipment, output the operation signal for driving the swing body until an angle of the swing body reaches the start angle after the bucket has reached a loading point above a loading target, and based on the bucket being positioned at the loading point, output the operation signal for driving the work equipment until a posture of the bucket with respect to the swing body reaches a preset target posture different from an initial posture of the bucket at the start of the automatic loading control.

2. The control device according to claim 1, wherein the processor is configured to, based on the automatic loading control being started, output the operation signal to move the bucket to the loading point by driving the swing body and the work equipment until the bucket reaches the loading point.

3. The control device according to claim 1, wherein a position of the bucket related to the preset target posture is a position which does not interfere with a virtual circular cylinder circumscribing the support part.

4. The control device according to claim 1, wherein the processor is further configured to:

output an operation signal for driving the bucket to execute a dump operation based on the bucket overlapping with the loading target in a plan view when viewed from above the loading machine, wherein the processor is configured to output the operation signal during execution of the dump operation.

5. The control device according to claim 1, wherein the preset target posture is a posture with teeth of the bucket facing the object to be excavated.

6. The control device according to claim 5, wherein the preset target posture is a posture with the bucket being at a height corresponding to the object to be excavated.

7. The control device according to claim 1, wherein the preset target posture is a posture in which the swing body is directed in an azimuth direction for a start of excavation of a subsequent excavation work.

8. The control device according to claim 1, wherein the loading target comprises a dump truck.

9. A control method for a loading machine, the loading machine including a swing body configured to swing around a swing center, a support part supporting the swing body, and work equipment including a bucket and attached to the swing body, the control method comprising:

determining a start angle of the swing body for a start of an automatic loading control of the loading machine;

starting the automatic loading control in a state in which the work equipment excavates an object and the bucket holds an excavated part of the object;

outputting an operation signal for driving the swing body until an angle of the swing body reaches the start angle after the bucket has reached a loading point above a loading target; and based on the bucket being positioned at the loading point, outputting an operation signal for driving the work equipment until a posture of the bucket with respect to the swing body reaches a preset target posture that is different from an initial posture of the bucket at the start of loading.

* * * * *